United States Patent [19]

McGinley

[11] 4,253,719

[45] Mar. 3, 1981

[54] ELECTRICAL EDGE CONNECTOR

[75] Inventor: William J. McGinley, Barrington, Ill.

[73] Assignee: Methode Electronics, Inc., Chicago, Ill.

[21] Appl. No.: 115,563

[22] Filed: Jan. 28, 1980

Related U.S. Application Data

[63] Continuation of Ser. No. 871,486, Jan. 23, 1978, abandoned.

[51] Int. Cl.[3] ..... H01R 13/62; H01R 13/514

[52] U.S. Cl. ..... 339/61 M; 339/75 MP; 339/176 MP

[58] Field of Search ..... 339/17 CF, 17 F, 61 M, 339/59 R, 59 M, 74 R, 75 R, 75 M, 75 MP, 176 M, 176 MP, 176 MF, 186 M

[56] References Cited

U.S. PATENT DOCUMENTS

| | | | |
|---|---|---|---|
| 3,107,961 | 10/1963 | Hahn et al. | 339/75 MP |
| 3,475,717 | 10/1969 | Lane | 339/75 MP |
| 3,701,071 | 10/1972 | Landman | 339/91 R X |
| 3,710,303 | 1/1973 | Gallager Jr. | 339/61 M |
| 3,771,109 | 11/1973 | Bruckner | 339/221 M X |
| 3,953,096 | 4/1976 | Williams | 339/176 MP X |
| 3,994,555 | 11/1976 | Konno | 339/91 R X |
| 4,069,403 | 1/1978 | Beaudette et al. | 339/75 MP |

OTHER PUBLICATIONS

IBM Bulletin–Connector–Hill et al., –1968–02, vol. 10, No. 9, p. 1331.

*Primary Examiner*—John McQuade
*Assistant Examiner*—John S. Brown
*Attorney, Agent, or Firm*—Charles F. Pigott, Jr.

[57] ABSTRACT

An electrical connector for mounting on the edge of a printed circuit board, the connector having a plurality of terminals which engage against electrically conductive contact fingers formed on the printed circuit board adjacent the edge thereof, and the connector being designed to clamp over an edge portion of the circuit board so as to permit a high contact pressure between the connector terminals and the circuit board fingers without requiring a high insertion force to interconnect the connector with the circuit board.

11 Claims, 9 Drawing Figures

FIG. 7
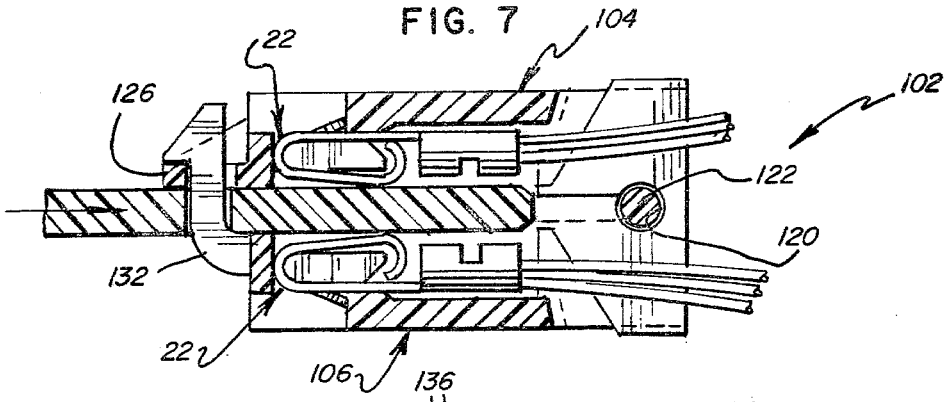
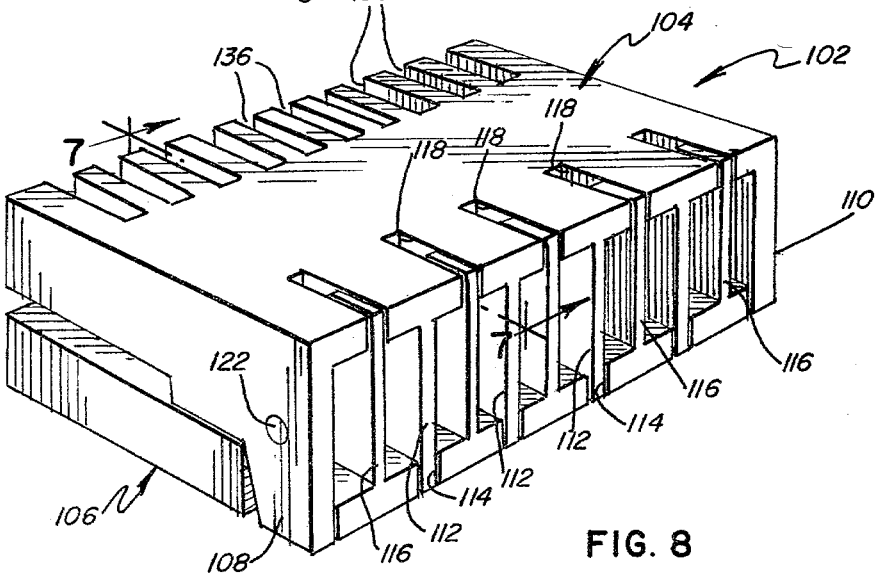
FIG. 8
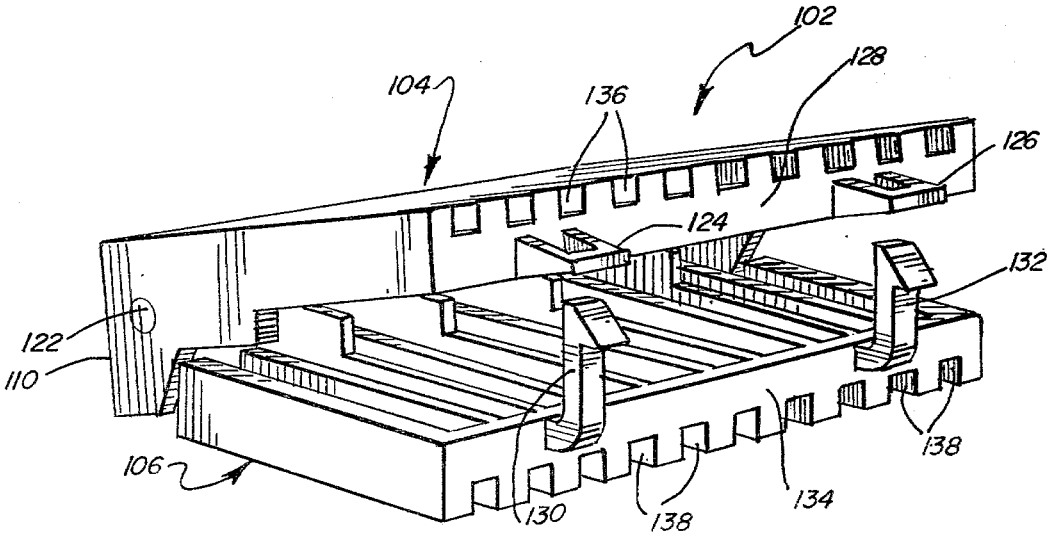
FIG. 9

ELECTRICAL EDGE CONNECTOR

This is a continuation of application Ser. No. 871,486, filed Jan. 23, 1978 and now abandoned.

BRIEF SUMMARY OF THE INVENTION

The present invention relates to an electrical connector for mounting on an edge portion of a printed circuit board to establish electrical contact between a plurality of terminals in the connector and a plurality of conductive contact fingers formed on one or both sides of the circuit board adjacent the edge thereof.

It is known to provide an electrical connector for connecting to the edge of a printed circuit board. Such edge connectors conventionally include an elongated slot which receives the edge of the circuit board when the connector is mounted thereon. The circuit board is thus forced in the slot formed in the connector so that terminals in the connector are engaged and pressed against conductive contact fingers on the circuit board, and once the circuit board is forced into the slot in the connector it is held therein by friction.

A conventional edge connector as above described has the disadvantage that the fit between the connector and the printed circuit board cannot be made too tight or it will not be possible to readily slide the edge of the circuit board into the connector slot. Accordingly, the magnitude of contact pressure must be limited in order that the two components can readily be assembled, even though by limiting the contact pressure you reduce the frictional force which holds the components in assembled relation. In addition, a relatively low contact pressure between the connector terminals and circuit board fingers results in higher contact resistance.

It is a general object of the present invention to provide an electrical edge connector which permits use of a high contact pressure between the connector terminals and circuit board fingers, and yet requires only a minimum insertion force in order to mount the connector on the edge of a circuit board.

A related object of the inventon is to provide an electrical edge connector which requires a minimum insertion force to mount the connector on the edge of a circuit board, and yet provides gas tight connections between the connector terminals and the conductive fingers on the circuit board.

Still another object is to provide an edge connector which will readily accommodate printed circuit boards of varying thicknesses.

A more specific object of the invention is to provide an electrical edge connector having a pair of hingedly connected insulator housing sections which clamp over the edge portion of a circuit board and lock to each other to grip the circuit board therebetween.

The foregoing and other objects and advantages of the invention will be apparent from the following description of a preferred embodiment, taken in conjunction with the accompanying drawings.

DESCRIPTION OF THE DRAWINGS

FIG. 7 is a transverse sectional view showing a further alternative embodiment of an electrical edge connector constructed in accordance with the present invention, the view being taken approximately along the line 7—7 of FIG. 8;

FIG. 8 is a perspective view of the electrical edge connector of FIG. 7; and

FIG. 9 is a perspective view of the edge connector of FIG. 7 showing the connector partially open in unlocked condition.

Now, in order to acquaint those skilled in the art with the manner of making and using the invention, there are described below, in conjunction with the accompanying drawings, certain preferred embodiments of the invention.

DETAILED DESCRIPTION OF THE INVENTION

Figure 1:
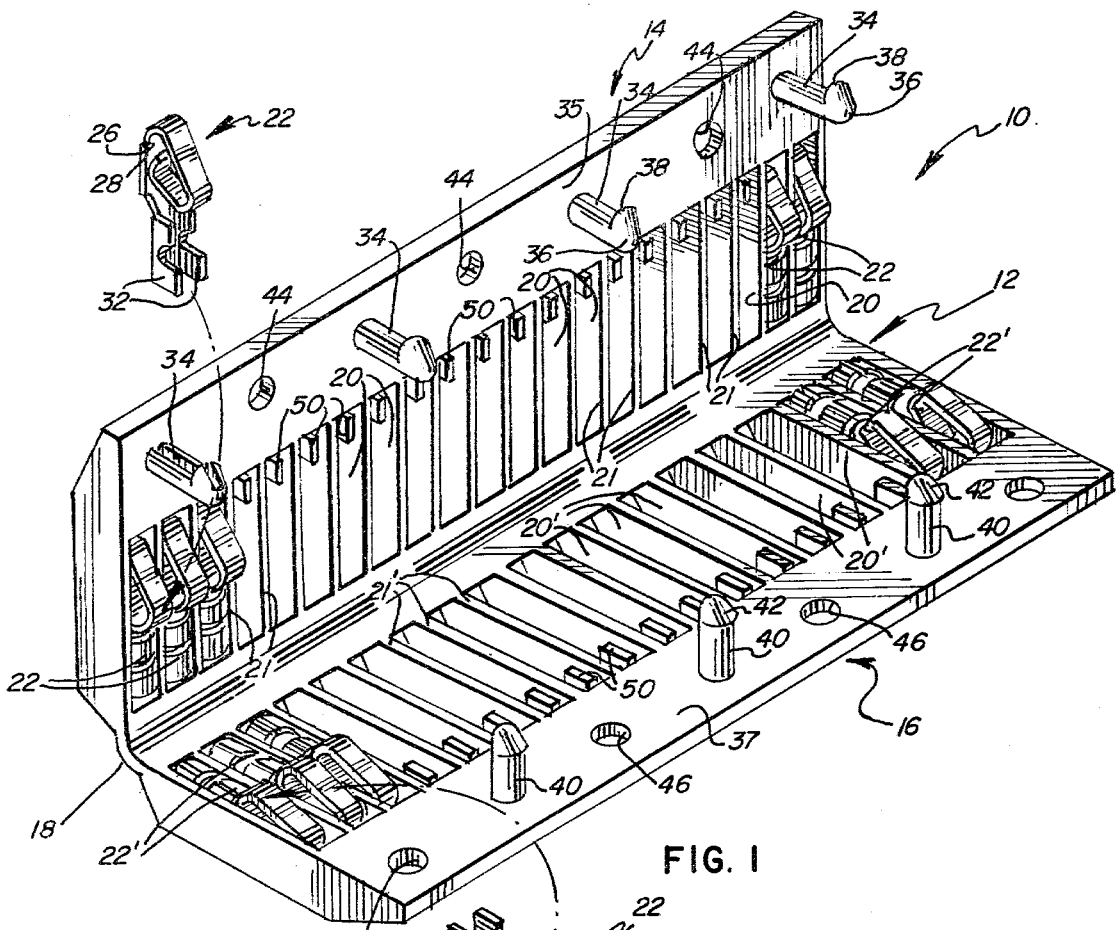
FIG. 1 is a perspective view of an electrical edge connector constructed in accordance with the present invention, there being shown in insulator housing member having two housing sections with a plurality of terminals in each of the housing sections.
Figure 2:
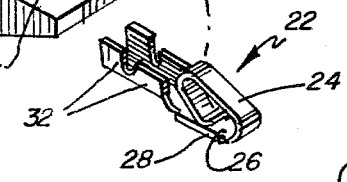
FIG. 2 is a transverse sectional view showing the manner in which the electrical connector of FIG. 1 mounts on the edge of a printed circuit board and locks thereon.
Figure 2:
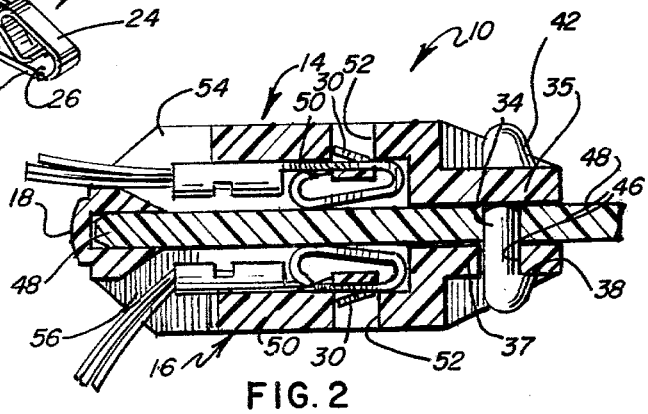

Referring now to the drawings, and in particular to FIGS. 1 and 2, there is shown a connector 10 including an insulator housing 12 having a pair of housing sections 14 and 16 connected along a relatively thin integral hinge member 18 which extends the length of the housing. The insulator housing 12 is preferably molded from thermoplastic material such as nylon, and the integral web 18 which connects the two housing sections 14 and 16 is relatively flexible so as to function as a hinge permitting the two housing sections to be pivoted relative to one another between the positions of FIGS. 1 and 2. The connector 10 is intended to mount on the edge of a circuit board having conductive contact fingers on both sides thereof, and thus both the housing section 14 and 16 contain terminal members for engagement with contact fingers on opposite sides of a circuit board.

As shown in FIG. 1, the housing section 14 includes a plurality of compartments 20 arranged in parallel side-by-side relation along the length of the housing, the compartments being separated by spaced parallel walls 21. Each of the compartments 20 contains a conductive metal terminal member as shown at 22. The terminals 22 are of known loop-shaped construction so as to be compressible, and each terminal includes an engageable portion 24, a base portion 26, side tabs 28 on the base portion, projecting bottom tab 30, and arms 32 for crimping over a conductor lead for connection therewith.

The housing section 14 includes a plurality of projecting legs 34 spaced along an outer longitudinal housing wall 35, each leg 34 having a locking head 36 on its end including a ledge portion 33. Similar locking legs 40 are provided along an outer longitudinal wall portion 37 of the housing section 16, each of the legs 40 having a locking head 42. Holes 44 are formed in the wall 35 of the housing section 14 to receive the locking legs 40, and similar holes 46 are formed in the wall 37 of the housing section 16 to receive the locking legs 34. The housing section 16 further includes a plurality of compartments 20' separated by parallel walls 21', and each of the compartments 20' contains one of the conductive terminal members 22.

FIG. 2 shows the electrical connector 10 mounted on an edge portion of a circuit board 48 and locked thereon by means of the various locking legs, such as the leg 34 which projects through one of the holes 46 with the locking ledge 38 engaged against the underside of the wall 37 of the housing section 16. It will be seen from FIG. 2 that each of the terminals 22 is held in its respective compartment by means of the base side tabs 28 which slide under side ribs 50 formed on the compartment side walls, and by the projecting tab 30 on each terminal base which snaps into an opening 52 formed in the housing wall in communication with each of the terminal compartments 20 and 20'.

It will be understood that with the housing sections 14 and 16 open as shown in FIG. 1, the connector 10 is placed over the edge portion of the circuit board 48 so the end of the board is positioned adjacent the hinge 18, and then the two housing sections are closed and snapped into locking relation as shown in FIG. 2, so as to clamp the circuit board therebetween under whatever contact pressure the housing is designed to provide. In the embodiment illustrated, the circuit board 48 represents a board having a plurality of conductive contact fingers (not shown) on both sides thereof, and in the mounted position as shown in FIG. 2, the row of terminals 22 in the upper housing section 14 are pressed down against the contact fingers on the upper side of the board 48, and the terminals 22 in the lower housing section 16 are pressed upwardly against the contact fingers on the lower side of the board. It will further be noted that each of the compartments 20 in the upper housing section 14 has an opening 54 (see FIG. 2) to accommodate leads connected to the terminals 22 in the housing section, and the lower housing section 16 has similar openings 56.

Figure 3:
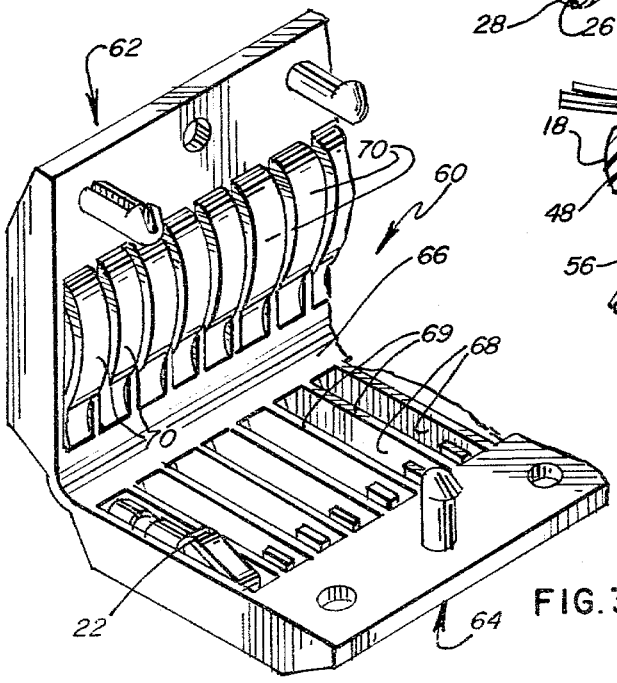
FIG. 3 is a fragmentary perspective view of an alternative embodiment of the electrical connector of the present invention adapted for mounting on a printed circuit board having contact fingers on only one side thereof.
Figure 4:
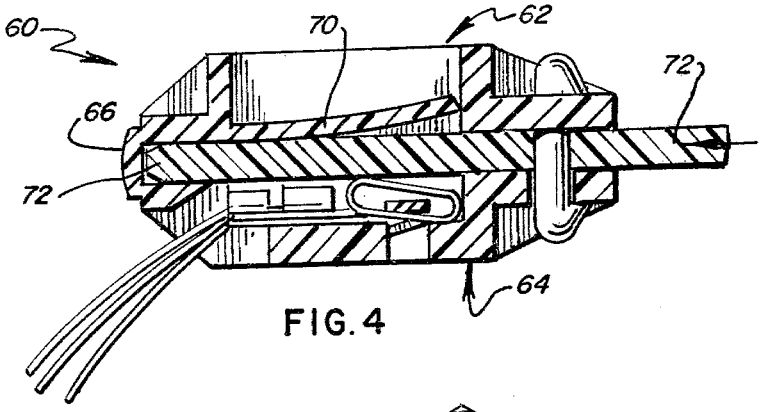
FIG. 4 is a transverse sectional view showing the electrical connector of FIG. 3 mounted on the edge of a circuit board.

FIGS. 3 and 4 illustrate an alternative embodiment comprising an electrical edge connector 60 for mounting on the edge of a circuit board having conductive contact fingers on only one side thereof. The connector 60 includes an upper housing section 62 and a lower housing section 64 interconnected by an integral hinge 66 as previously described. The lower housing section 64 includes a plurality of compartments 68 separated by parallel side walls 69 for holding terminals 22, as described above in connection with the embodiment of FIGS. 1 and 2. However, the upper housing section 62 includes a plurality of plastic spring fingers 70, there being one spring finger for cooperation with each of the terminal compartments 68 in the lower housing section 64.

As shown in FIG. 4, each spring finger 70 is integral with the housing body at one end thereof, while the opposite free end of the flexible spring finger is movable relative to the housing. When the edge connector 60 is closed and locked on a circuit board 72 having conductive contact fingers (not shown) only on the lower side thereof, for engagement of such circuit board fingers with the row of terminals 22, the plurality of flexible plastic spring fingers 70 bear down on the upper surface of the circuit board and provide the desired contact pressure between the connector terminals and the circuit board fingers.

Figure 5:
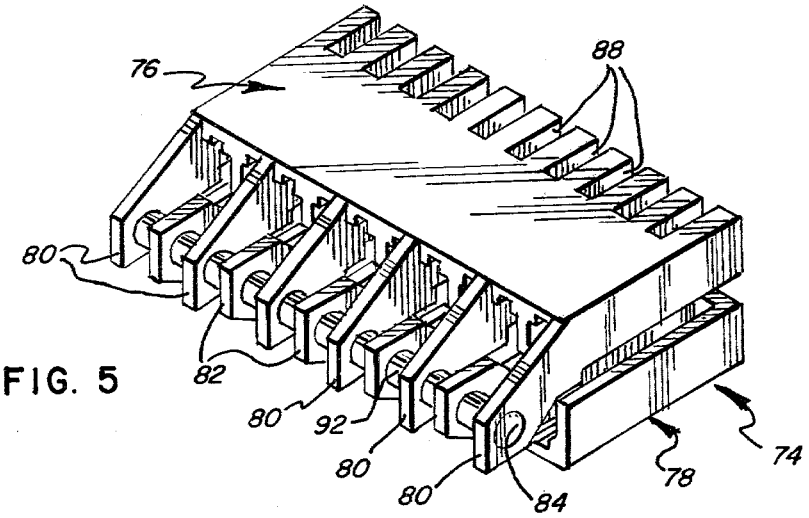
FIG. 5 is a perspective view of a further alternative embodiment of the invention where the connector housing comprises a pair of insulator housing sections hingedly connected by an elongated hinge pin member.
Figure 6:
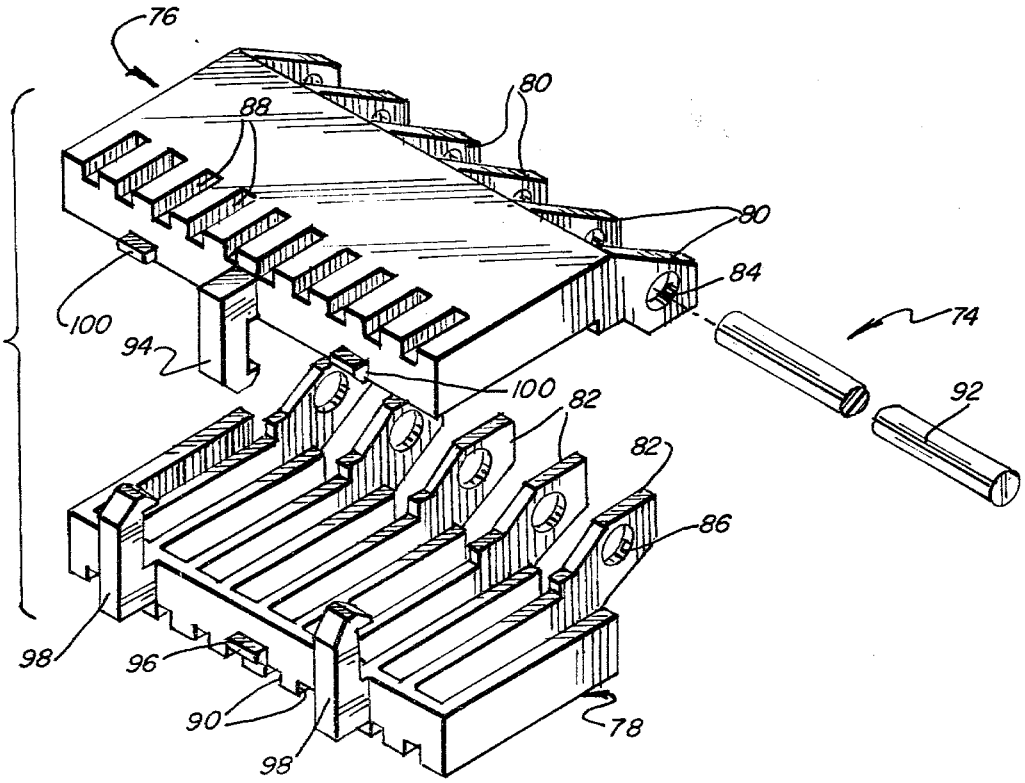
FIG. 6 is an exploded perspective view of the hinged insulator housing sections of FIG. 5.

FIGS. 5 and 6 illustrate a further embodiment of the present invention where an insulator housing 74 for an electrical edge connector comprises an upper housing section 76 and a lower housing section 78. The upper housing section 76 includes a plurality of integral arms 80 arranged in spaced parallel relation along the length of the housing, and the lower housing section includes a plurality of spaced parallel arms 82. The upper arms 80 each have an opening 84 therein, and the arms 82 each have an opening 86. The upper arms 80 are inclined somewhat downwardly as viewed in FIG. 5, and the lower arms 82 are inclined somewhat upwardly, whereby the openings 84 and 86 may be aligned on a common hinge axis where the two housing sections are closed relative to one another as shown in FIG. 5. The upper housing section 76 has a plurality of slots 88, and the lower housing section 78 has a similar plurality of slots 90, such slots being to receive and provide access to the locking tangs 30 on the terminals 22 as illustrated in FIG. 1, and there being one such slot in communication with each terminal compartment.

FIG. 5 shows a hinge pin 92 which extends through the openings in the arms 80 and 82 so as to hingedly connect the upper and lower housing sections, thereby permitting the housing sections to be open in the manner illustrated in FIG. 1, and to be clamped and locked on a circuit board in the manner shown in FIG. 2. FIG. 6 shows a hook 94 on the upper housing section which locks over a tab 96 on the lower housing section, and a pair of hooks 98 on the lower housing section which lock over corresponding tabs 100 on the upper housing section. The embodiment of FIGS. 5 and 6 includes a plurality of terminals 22 in one or both of the housing sections 76 and 78, as explained hereinabove in connection with the embodiments of FIGS. 1–4, and thus the terminals and terminal compartments for the housing 74 will not be further described herein.

FIGS. 7–9 illustrate an additional embodiment of the present invention where an insulator housing 102 for an electrical edge connector comprises an upper housing section 104 and a lower housing section 106. The upper housing section 104 includes a pair of parallel outer hinge arms 108 and 110. In addition, the upper housing section 104 includes a plurality of integral intermediate hinge arms 112 which are parallel to one another and have lower ends received in corresponding slots 114 formed in the lower housing section 106. The lower housing section 106 is provided with a plurality of integral parallel hinge arms 116 located between corresponding pairs of the upper hinge arms 112 and having upper ends received in corresponding slots 118 formed in the upper housing section 104.

The upper housing hinge arms 108, 110 and 112 and the lower housing hinge arms 116 are formed with aligned pin openings as shown at 120 in FIG. 7, and a hinge pin 122 extends through the pin openings in the plurality of hinge arms so as to hingedly connect the upper and lower housing sections 104 and 106 thereby permitting the sections to be opened as generally illustrated in FIG. 9 and to be clamped and locked on a circuit board in the manner shown in FIG. 7.

A pair of apertured projecting arms 124 and 126 are formed integrally on a front wall 128 of the upper housing 104 and project forwardly therefrom, and a pair of corresponding hook members 130 and 132 are formed on a front wall 134 of the lower housing section 106.

When the upper and lower housing sections are closed as shown in FIGS. 7 and 8, the enlarged ends of the hook members 130 and 132 snap through the apertures in the arms 124 and 126 and releasably lock the two housing sections together as shown in FIG. 7.

The upper housing section 104 has a plurality of slots 136 and the lower housing section 106 has a similar plurality of slots 138, such slots being to receive and provide access to the locking tangs 30 on the terminals 22 as illustrated in FIG. 1, there being one such slot in communication with each terminal compartment. The embodiment of FIGS. 7–9 includes a plurality of terminals 22 in one or both of the housing sections 104 and 106, such terminals being shown in FIG. 7 but omitted from the other views so as to better illustrate the structure of the insulator housing. The terminals 22 are described hereinabove in connection with the embodiments of FIGS. 1–4, and thus the terminals and terminal compartments for the housing 102 will not be further described herein.

It will now be understood that the edge connector of the present invention includes a pair of hingedly connected insulator housing sections which open to mount over the edge of a printed circuit board, and then close and lock on the edge portion of the board. Such an edge connector can provide a relatively high contact pressure if desired, and yet only a minimum insertion force is required to mount the connector on the edge of a circuit board, as compared with designs where one slides a circuit board into a slot formed in a connector. With the present invention the connector can be designed to clamp on the circuit board with as much contact pressure as is desired, without requiring any significant insertion force.

Another advantage of the present invention is that the connector can accommodate printed circuit boards of various thicknesses, and thus the mounting of the connector on the edge portion of the board will not be impaired by the presence of a certain amount of flow solder on the board.

What is claimed is:

1. An electrical edge connector for mounting on an edge portion of said printed circuit board or the like to clamp over such edge portion while permitting the remaining portion of the board to project from the connector, said connector comprising, in combination, an insulator housing including first and second housing sections permanently connected by hinge means along one end to permit said housing sections to be moved between an open position where an edge portion of a printed circuit board may be inserted therebetween, and a closed position where said housing sections may be brought into pressure contact with opposite sides of said printed circuit board to clamp the same therebetween, said hinge means being dimensioned to space said first and second housing sections when in closed position by an amount sufficient to accommodate therebetween said printed circuit board on which said connector is to be mounted, the ends of said first and second housing sections opposite said hinge means defining an opening therebetween when in said closed position to permit said printed circuit board to project out of said connector whereby only an edge portion of said printed circuit board is clamped between said first and second housing sections while the remainder of said printed circuit board projects clear of said connector, a plurality of conductive metal terminal members positioned in side-by-side compartments in one of said housing sections for pressure contact with electrically conductive portions formed on a side of said circuit board where the latter is clamped between said housing sections, a plurality of flexible spring-like members located in the other of said housing sections for pressure contact with the opposite side of said circuit board when the latter is clamped between said housing sections, and locking means for releasably locking said first and second housing sections in closed position clamped on said edge portion of said printed circuit board.

2. An electrical connector as defined in claim 1 where a plurality of said conductive metal terminal members are positioned in side-by-side compartments in each of said first and second housing sections for pressure contact with conductive portions formed on opposite sides of a circuit board.

3. An electrical connector as defined in claim 1 where said plurality of conductive metal terminal members are positioned in side-by-side compartments in said first housing section, and said spring-like members are provided in said second housing section for bearing against an adjacent side of a circuit board clamped in said housing and biasing the circuit board into pressure engagement with the terminals positioned in said first housing section.

4. An electrical connector as defined in claim 3 where said spring-like members are in side-by-side spaced relation along the length of said second housing section.

5. An electrical connector as defined in claim 3 where said second housing section is made of plastic, and said spring-lke members comprise a plurality of individual plastic spring members made integral with said second housing section and arranged in side-by-side relation along the length thereof.

6. An electrical connector as defined in claim 5 where said second housing section is provided with substantially one integral plastic spring member for each of the terminal compartments in said first housing section, each of said integral plastic spring members being substantially aligned with a corresponding one of said terminal compartments.

7. An electrical connector as defined in claim 1 where said first and second housing sections are made of plastic and are hingedly connected by an integral plastic hinge sufficiently flexible to permit said housing sections to be opened and closed relative to one another.

8. An electrical connector as defined in claim 1 where said first and second housing sections are hingedly connected by a hinge pin which passes through portions of each of said housing sections.

9. An electrical connector as defined in claim 8 where said first and second housing sections each have a plurality of parallel integral arms, the arms of said first and second housing sections being interconnected by a common hinge pin.

10. An electrical connector as defined in claim 1 where said locking means comprises a plurality of locking legs formed on one of said housing sections which extend into locked positions through openings formed in the other of said housing sections when said housing sections are in closed position clamped on an edge portion of a circuit board.

11. An electrical connector as defined in claim 1 where said locking means comprises a plurality of locking legs formed on one of said housing sections which hook over projecting members formed on the other of said housing sections when said housing sections are in closed position clamped on an edge portion of a circuit board.

* * * * *